US010632330B2

(12) United States Patent
Zhong

(10) Patent No.: US 10,632,330 B2
(45) Date of Patent: Apr. 28, 2020

(54) CBRN BREATHING APPARATUS

(71) Applicant: Avon Protection Systems, Inc., Cadillac, MI (US)

(72) Inventor: Harry Xia Zhong, Baltimore, MD (US)

(73) Assignee: AVON PROTECTION SYSTEMS, INC., Cadillac, MI (US)

( * ) Notice: Subject to any disclaimer, the term of this patent is extended or adjusted under 35 U.S.C. 154(b) by 262 days.

(21) Appl. No.: 15/752,432

(22) PCT Filed: Sep. 8, 2016

(86) PCT No.: PCT/US2016/050707

§ 371 (c)(1),
(2) Date: Feb. 13, 2018

(87) PCT Pub. No.: WO2017/044582

PCT Pub. Date: Mar. 16, 2017

(65) Prior Publication Data

US 2019/0009115 A1 Jan. 10, 2019

Related U.S. Application Data

(60) Provisional application No. 62/215,897, filed on Sep. 9, 2015.

(51) Int. Cl.
*A62B 9/02* (2006.01)
*A62B 18/00* (2006.01)
(Continued)

(52) U.S. Cl.
CPC ..... *A62B 9/02* (2013.01); *A62B 7/04* (2013.01); *A62B 7/10* (2013.01); *A62B 9/006* (2013.01); *A62B 18/006* (2013.01); *A62B 18/08* (2013.01)

(58) Field of Classification Search
CPC .... A62B 7/00; A62B 7/02; A62B 7/04; A62B 7/10; A62B 7/12; A62B 9/006;
(Continued)

(56) References Cited

U.S. PATENT DOCUMENTS 7,658,190 B1 * 2/2010 Phifer ..... A62B 7/10 128/201.25
7,748,380 B1 7/2010 Phifer et al.
(Continued)

FOREIGN PATENT DOCUMENTS

DE 19503027 A1 3/1996
EP 2008692 A2 12/2008
(Continued)

*Primary Examiner* — Joseph D. Boecker
(74) *Attorney, Agent, or Firm* — McGarry Bair PC

(57) ABSTRACT

An air delivery hose (10) has a CBRN resistant outer butyl rubber layer (12) convolute over a metal wire reinforced thermoplastic polyurethane inner hose (14). A combination unit respirator (20) has an air delivery hose (10, 10') with a proximal end (22) with a three position lockable switch (40) that allows selection of APR, PAPR or SCBA modes, and a distal end (24) with a compact demand valve (30) responsive to the switch position. A filter cover accessory (60) is a modular accessory to a PAPR manifold that protects a PAPR filter (62) from premature degradation in harsh environments.

18 Claims, 12 Drawing Sheets

(51) Int. Cl.

| | |
|---|---|
| ***A62B 18/08*** | (2006.01) |
| ***A62B 7/04*** | (2006.01) |
| ***A62B 7/10*** | (2006.01) |
| ***A62B 9/00*** | (2006.01) |

(58) Field of Classification Search
CPC ..... A62B 9/02; A62B 9/022; A62B 9/025; A62B 18/00; A62B 18/006; A62B 18/02; A62B 18/025; A62B 18/08; A62B 18/10; A62B 17/04; A42B 3/28; A42B 3/286; A42B 3/288; B63C 11/14; B63C 11/18
See application file for complete search history.

(56) References Cited

U.S. PATENT DOCUMENTS

| | | | | |
|---|---|---|---|---|
| 2005/0051169 | A1* | 3/2005 | Gossweiler ..... | A62B 9/02 128/205.24 |
| 2006/0048777 | A1* | 3/2006 | Brookman ..... | A62B 7/02 128/201.22 |
| 2014/0190483 | A1* | 7/2014 | Hansen ..... | A62B 7/02 128/205.12 |
| 2015/0047638 | A1* | 2/2015 | Robey ..... | A62B 7/02 128/204.22 |
| 2015/0128937 | A1 | 5/2015 | Teetzel et al. | |
| 2015/0367150 | A1* | 12/2015 | Zheng ..... | A62B 9/006 128/202.22 |

FOREIGN PATENT DOCUMENTS

| | | | |
|---|---|---|---|
| JP | 2007236814 | | 9/2007 |
| WO | 2010/091002 | A2 | 8/2010 |
| WO | 2010/091002 | A9 | 8/2010 |
| WO | 2013/103343 | A1 | 7/2013 |
| WO | 2013/103343 | A9 | 7/2013 |

* cited by examiner

CBRN BREATHING APPARATUS

CROSS REFERENCE TO RELATED APPLICATIONS

The application is a National Phase application of International Application No. PCT/US2016/050707, filed Sep. 8, 2016, which claims the benefit of U.S. Application No. 62/215,897 filed Sep. 9, 2015, both of which are incorporated herein in their entireties.

BACKGROUND

A breathing apparatus for chemical, biological, radiological and nuclear (CBRN) agents is improved with flexibility, adaptability and modularity. This disclosure includes such benefits arising from an improved hose construction, an improved demand valve, and an improved filter cover.

Crushproof Tubing Company in U.S. Pat. No. 7,431,054 discloses a method of manufacturing a wire reinforced flexible rubber hose for use in breathing air applications. The method comprises positioning a section of wire-reinforced tubing on a forming mandrel and then positioning a sleeve of uncured rubber to cover the section of wire-reinforced tubing. Cording is then wrapped around the sleeve of uncured rubber such that each adjacent wrapping of cording is disposed between and separated by the wire helix of the wire-reinforced tubing. The sleeve of uncured rubber is cured while the cording is wrapped thereon to form a cured hose. The cured hose has a relatively smooth bore. All three plies of the cured hose can be formed from relatively thin walled materials.

Usui Kokusai Sangyo Kaisha Ltd. in U.S. Pat. No. 4,982,765 discloses a flexible composite hose with an inner tube formed from a synthetic resin, an outer tube formed from a thermally shrinkable synthetic resin. The hose has a relatively small wall thickness and carries an adhesive on its inner peripheral surface, and a metal wire interposed spirally between the inner and outer tubes. The adhesive and the thermal shrinkage of the thermally shrinkable resin cause the inner peripheral surface of the outer tube to stick closely to the inner tube and the wire. The outer tube has a spirally corrugated outer peripheral surface defined by the wire. The disclosed materials are Nylon and PVC.

SUMMARY OF THE INVENTION

In an aspect of the invention, a combination unit respirator includes a breathing hose having a first end and a second end, the first end configured to connect to a respiratory apparatus worn by a user. A compact demand valve is in fluid communication with the second end. The compact demand valve has a first connector configured to connect to a self-contained breathing apparatus (SCBA) and a second connector configured to connect to a powered air purifying respirator (PAPR). A switch is coupled to the compact demand valve and configured to selectively enable the compact demand valve to cause air flow from one of the SCBA or the PAPR to the breathing hose.

BRIEF DESCRIPTION OF THE DRAWINGS

In the drawings:

FIG. 4(*b*) is a cross-sectional view of a valve assembly at a second position in the combination unit respirator of FIG. 3.

FIG. 4(*c*) is a cross-sectional view of a valve assembly at a third position in the combination unit respirator of FIG. 3.

DESCRIPTION OF EMBODIMENTS

Figure 1:
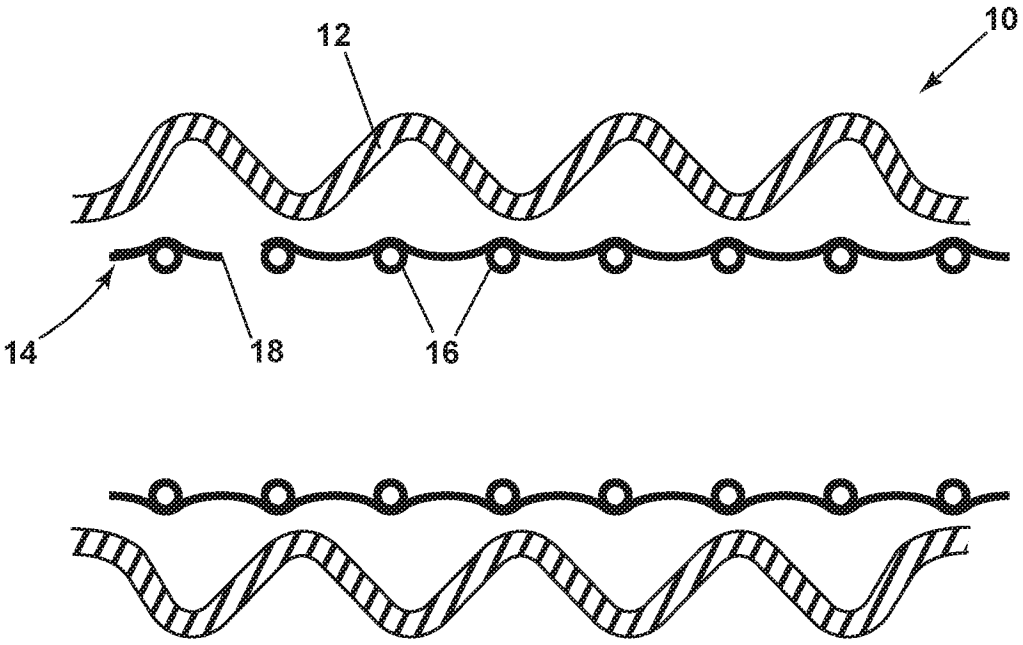
FIG. 1 is a cross sectional view of an air delivery hose construction according to the invention.
Figure 2:
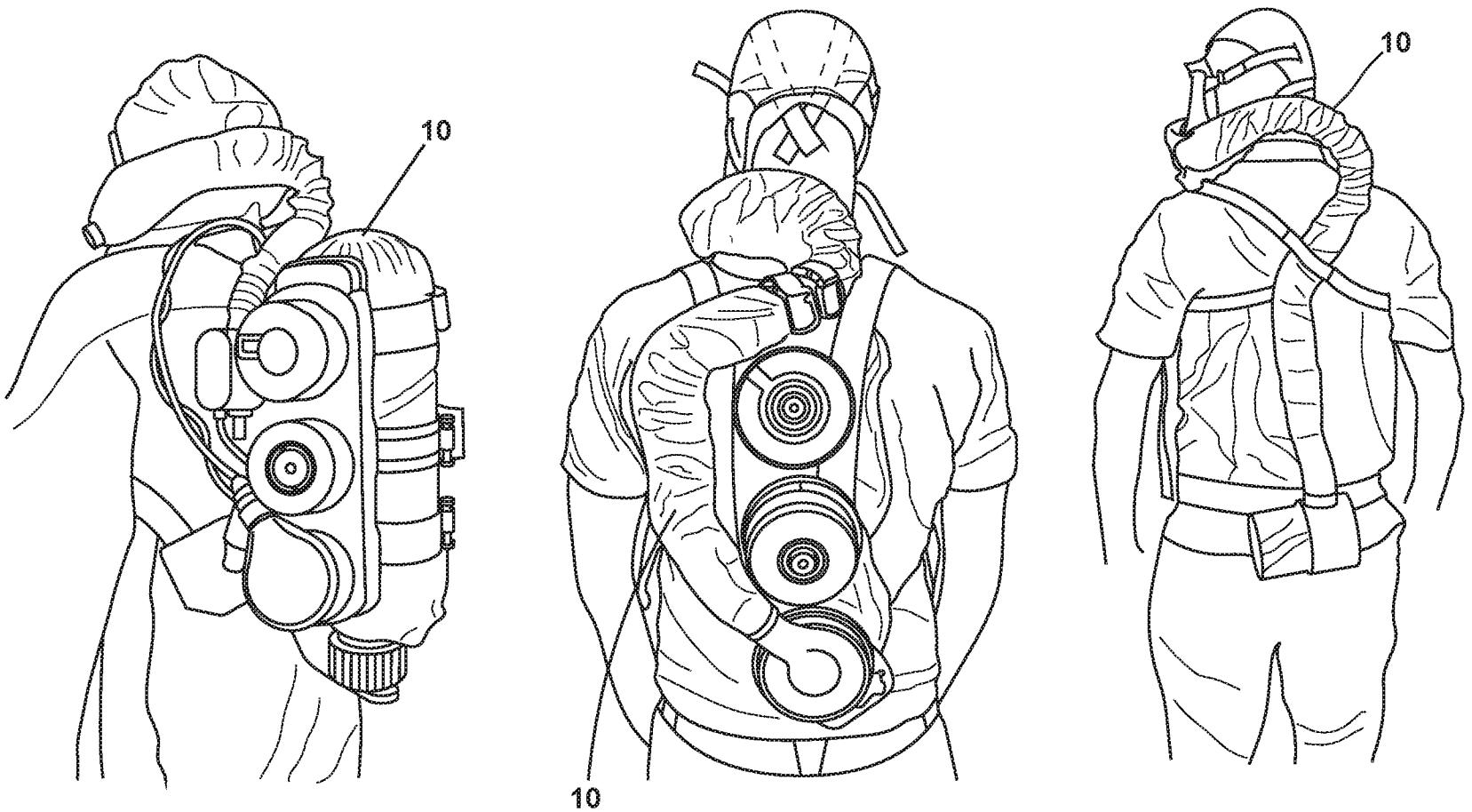
FIG. 2 shows how the flexibility of the hose construction of FIG. 1 results in ease of use.

Referring to the drawings and to FIGS. 1-2 in particular, an air delivery hose 10 specifically for CBRN applications has a CBRN resistant outer butyl rubber layer 12 convolute over a metal wire reinforced thermoplastic polyurethane (TPU) inner hose 14. The butyl rubber outer hose 12 is thin walled for reduced weight, but still serves as a chemical barrier for CBRN applications. Alternatively, other barrier materials that provide resistance to chemical agents may be used for the outer cover. The metal reinforced inner hose 14 includes a single wire helix 16 enclosed in a thermoplastic polyurethane sleeve 18 that may or may not be bonded to the wire. The outer hose 12, preferably pre-cured, slides over the TPU reinforced inner hose 14 to create a highly flexible hose 10 that inhibits kinking or crushing yet provides a consistent smooth bore for lowered airflow resistance.

The overall combination of light weight and flexibility allows the hose to be routed in a unique S shape with attachment points located at the nape of the neck which prevents movement of a face mask relative to the face during head movement leading to improved protection of the wearer and less inward leakage. The same S shape routing also allows for same length hose be used for different sized users as the S shape takes up additional slack by moving anchor point left or right along length of hose. Examples of routing the hose 10 are shown in FIG. 2. Typical dimensions for the hose 10 may include an inner diameter of the outer hose being about 40 mm or less; an overall length of outer hose at about 36" or less; a corrugation depth of outer hose at about 4-5 mm; a corrugation pitch of outer hose at about 69 corrugations/meter; an outside diameter of the inner hose at about 1.40" inches or less; an overall length of the inner hose at about the same as the outer hose; a wall thickness of the inner hose: at about 0.011"; a corrugation depth of the inner hose at about 0.1"; and a corrugation pitch of the inner hose at about 1/0.40".

Figure 3:
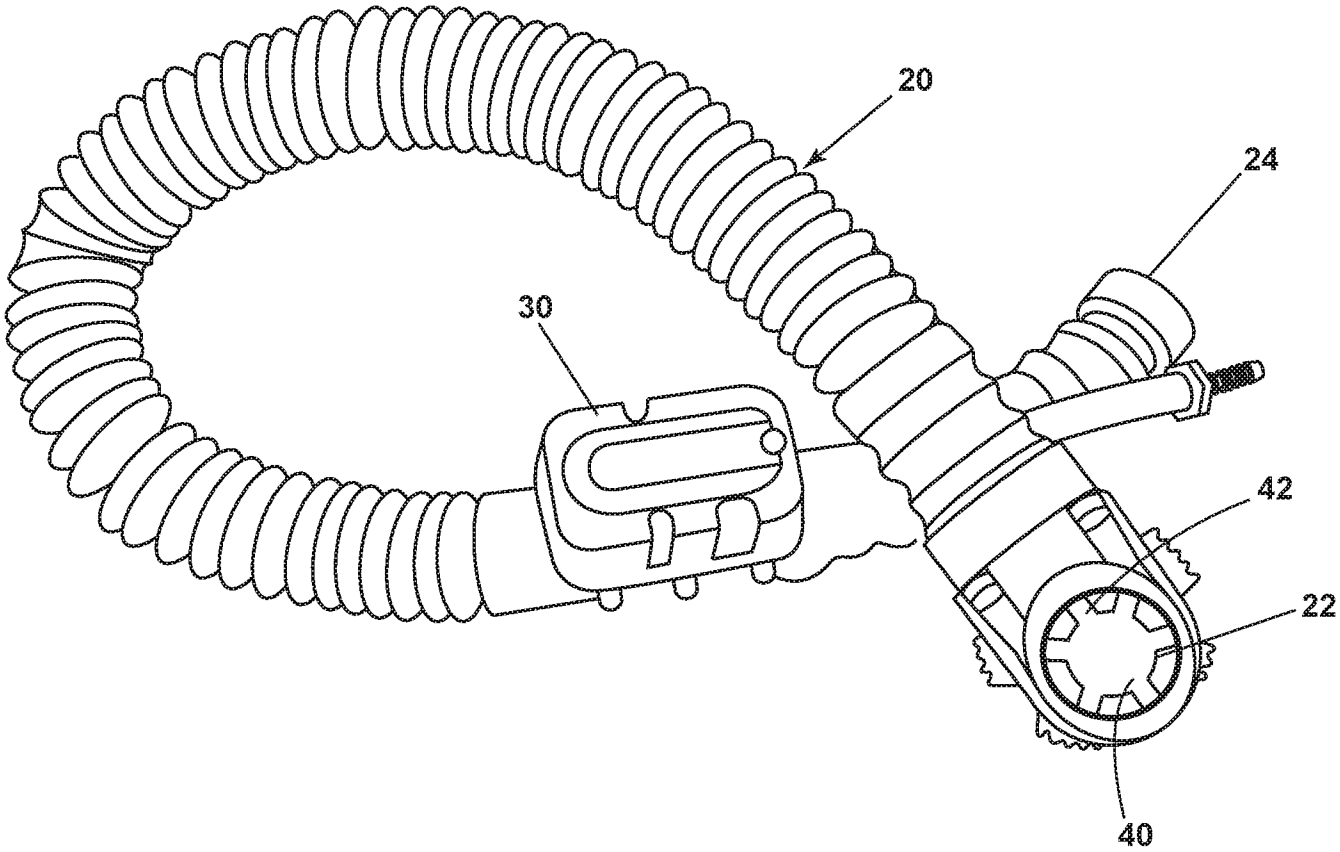
FIG. 3 is a perspective view of a combination unit respirator that enables quick selection of different modes according to the invention.
Figure 8:
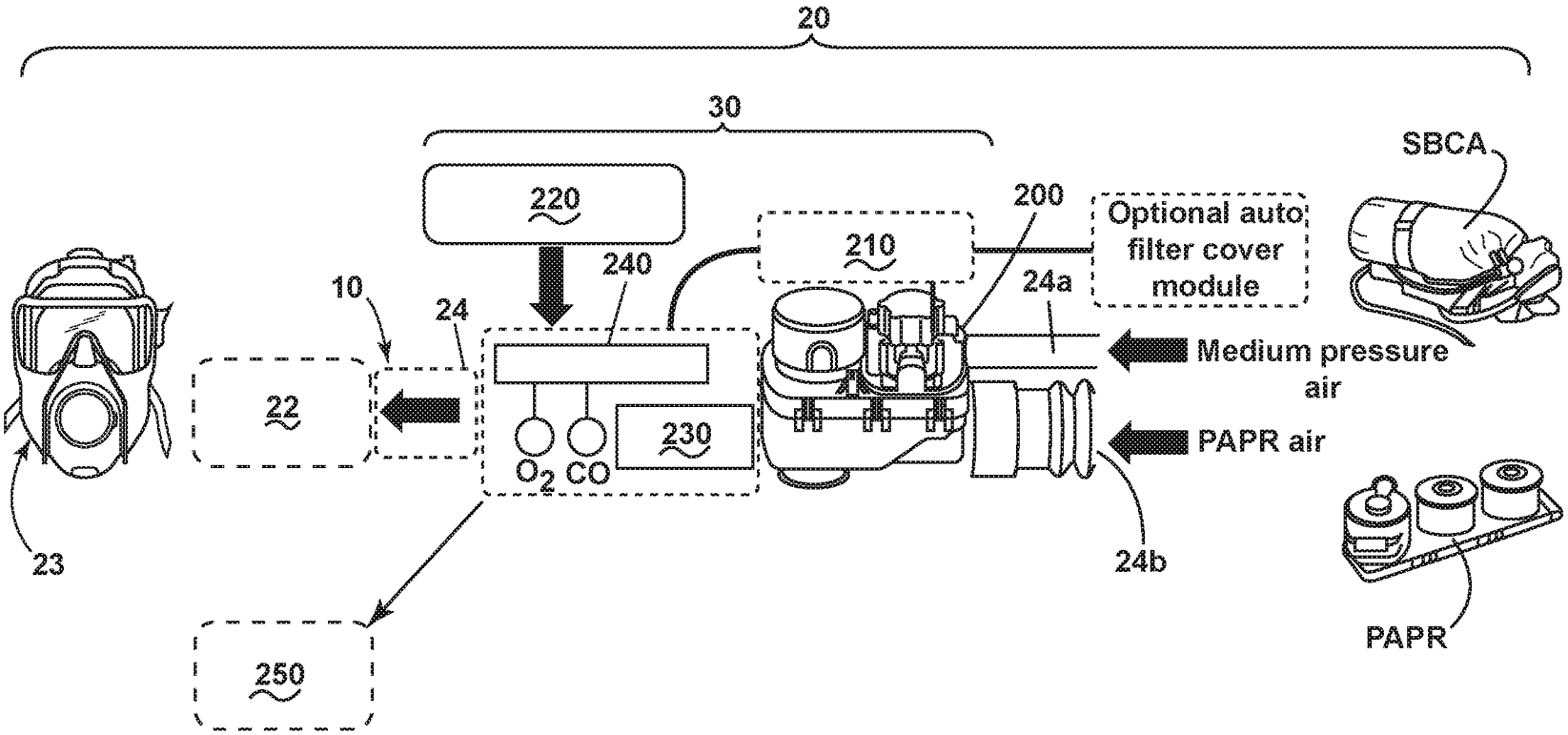
FIG. 8 is a schematic view of an embodiment of a combination unit respirator that enables automatic selection of different modes according to the invention.

Such a hose is especially applicable in a combination unit respirator (CUR) system 20. Turning now to FIGS. 3, 4 and 8, a CUR system 20 allows a user to quickly select one of several different modes with a single motion. Common modes include an air purifying respirator (APR) mode where ambient, filtered air is directed to the face mask and the wearer, a powered air purifying respirator (PAPR) mode where ambient filtered air is powered to the face mask and the wearer, and a self-contained breathing apparatus (SCBA) mode where pressurized air from a tank is directed to the face mask and the wearer, excluding ambient air. The CUR system 20 includes an air delivery hose 10' but it may or not be the CBRN air delivery hose 10 of FIGS. 1 and 2. The hose 10' in the CUR system 20 has a proximal end 22 and a distal end 24. The proximal end 22 is configured to connect to a respiratory air apparatus on a user such as a face mask (23). A switch 40 can be located at the proximal end 22 for easy access by a user, even on or near the user's cheek, for example. A control and demand valve (CDV) 30 is located preferably towards the distal end 24 of the CUR system 20 and coupled to the switch 40. Preferably the switch 40 is a pneumatic switch or at least comprises pneumatic switch elements. The distal end 24 also includes a first connector 24*a* configured to connect to a medium pressure hose from a regulator in an SCBA, and a second connector 24*b* configured to connect to a filtered air port from a blower in a PAPR. The switch 40 is a three position lockable switch that allows selection of APR, PAPR or SCBA modes. Preferably, a middle position for a rotatable knob 42 is designated for APR mode, and the hose 20 should be stored in the APR mode, and set as a default before donning a given apparatus. It will be understood that air in the APR or PAPR modes will be ambient air, and air from the SBCS is air from the tank of an SBCA apparatus at medium pressure after release from a regulator, normally in a range of 60-140 psig.

Once the CUR system 20 is connected to an air apparatus 23 and donned by a user, the system is first primed by opening a pressure vessel valve (e.g., a hand wheel) on the SBCA causing medium pressure air to be supplied to the CDV 30; no air from the SBCA is supplied to the mask 23 while the switch 40 is in the APR mode position. The system is now in a "primed" condition and the user may now select an operating mode, either leaving the system in APR mode, or actively selecting the PAPR or SCBA mode by depressing and rotating the knob 42. While in the APR mode, the wearer can breathe ambient air filtered by the filters in the PAPR, but air is not forced into the hose 10'. Depressing and rotating the knob 42 to the PAPR position will activate an electric blower in the PAPR and commence delivery of filtered air under power to the mask 23 via the breathing hose 10', effectively bypassing the CDV 30. Depressing and rotating the knob 42 to the SCBA position will activate the CDV 30 automatically closing off a PAPR air inlet port contained in the breathing hose 10'. Depressing and rotating the knob 42 to the APR position again will automatically shut off the PAPR blower.

Figure 4A:
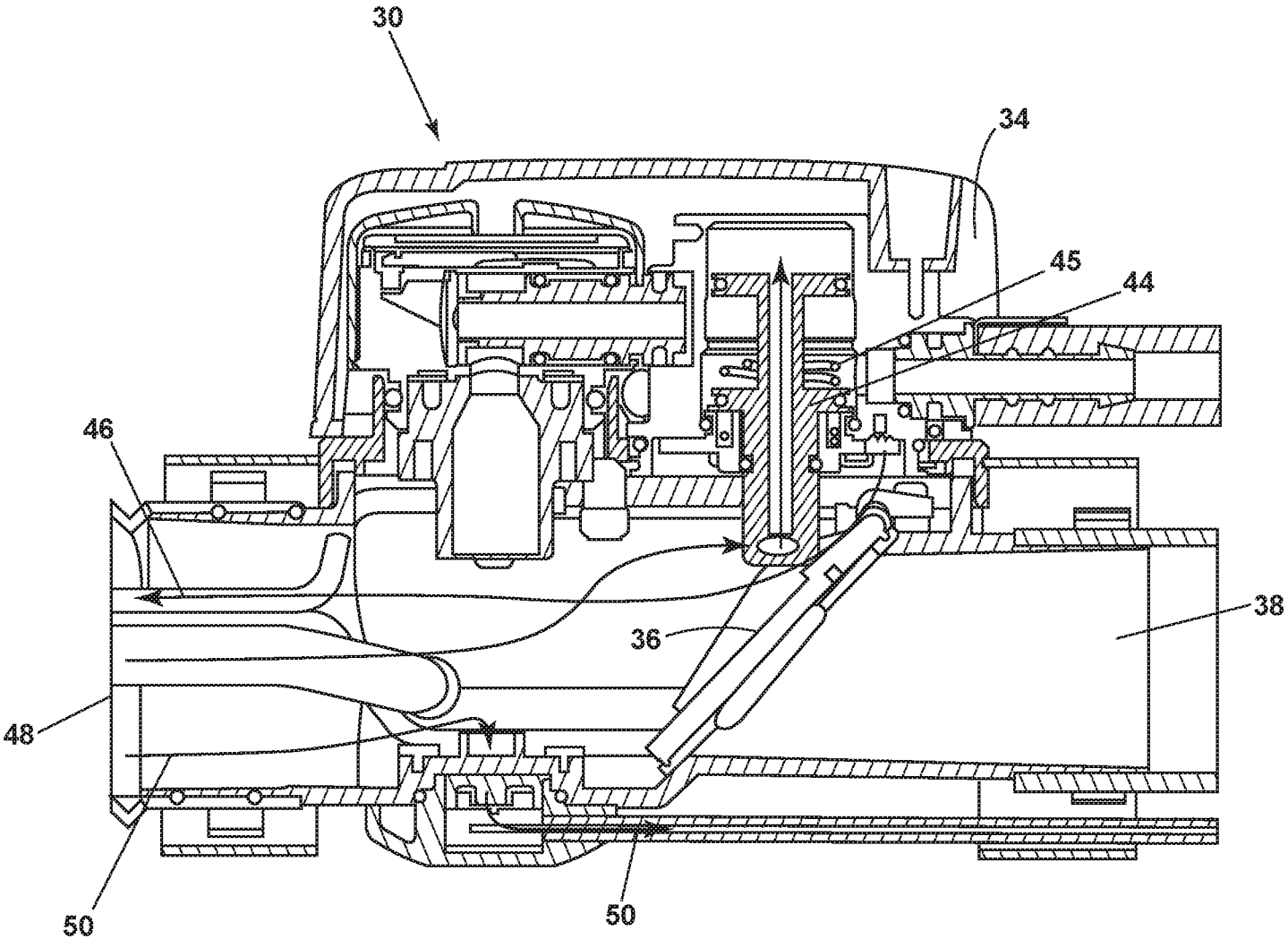
FIG. 4(*a*) is a cross-sectional view of a valve assembly at a first position in the combination unit respirator of FIG. 3.
Figure 4B:
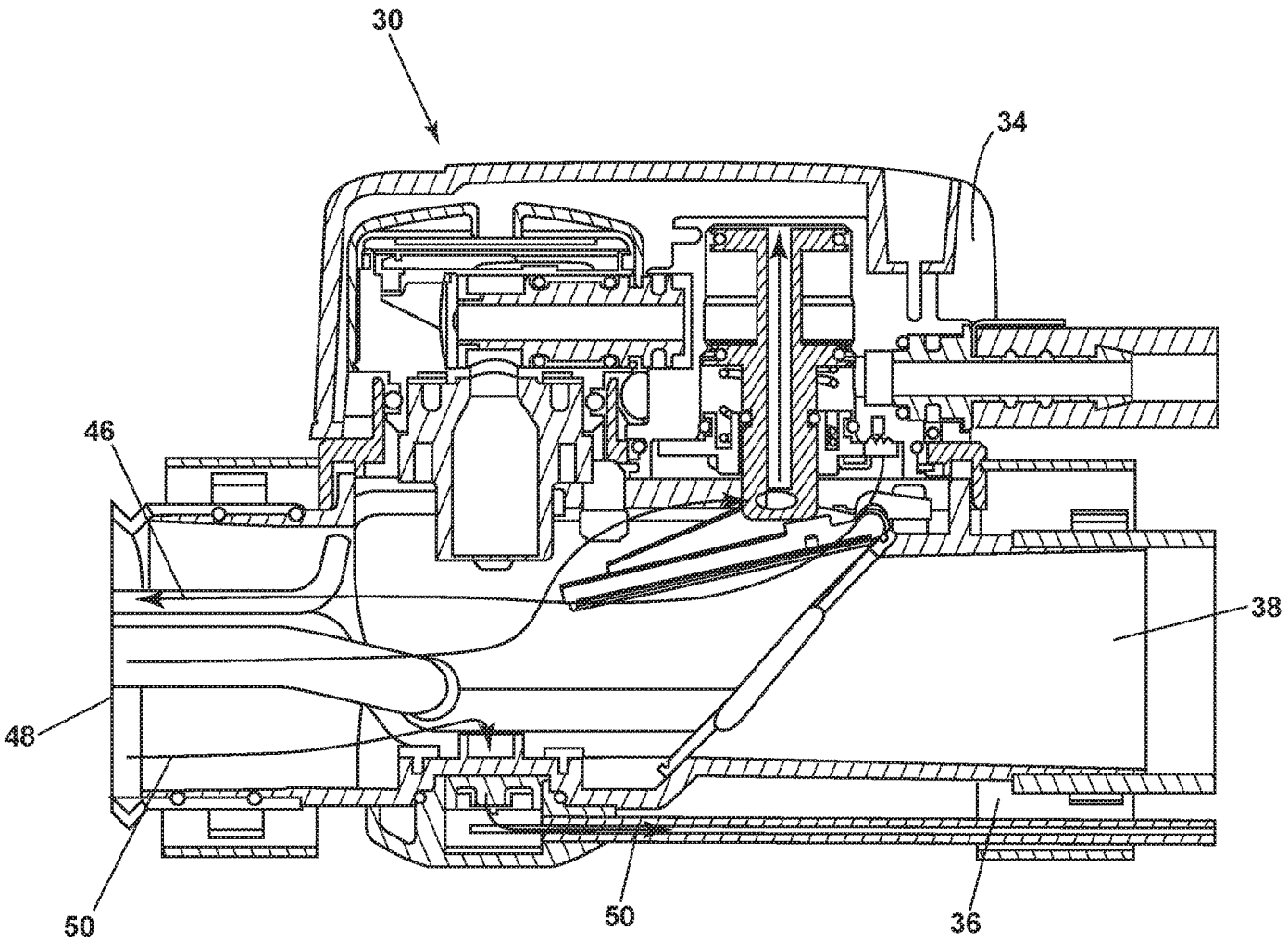
Figure 4C:
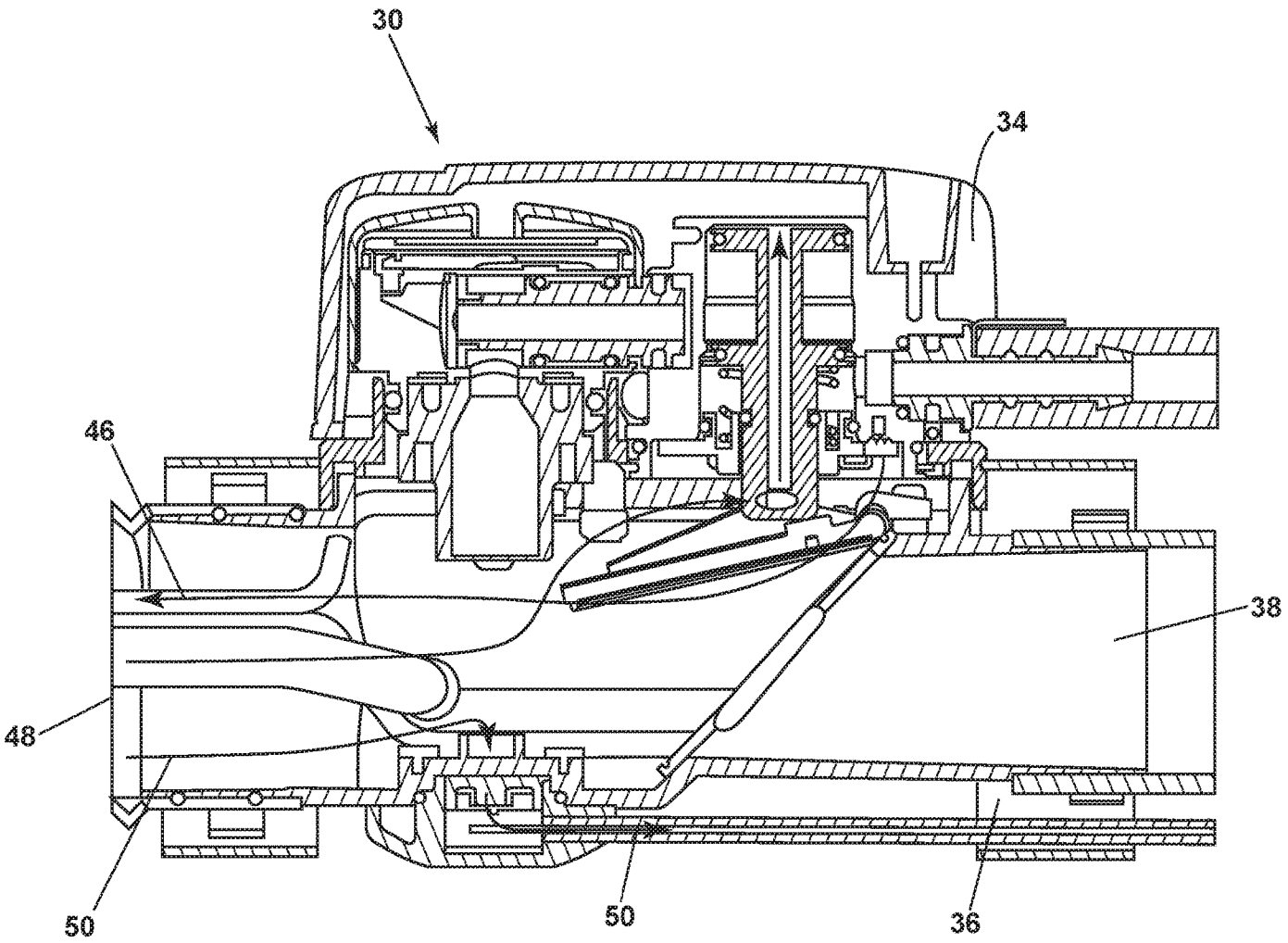

Looking more closely at FIGS. 4*a*, 4*b*, and 4*c*, pressurized air from an SCBA is fed into a control valve 34 of the CDV 30. This control valve has two purposes to-wit: first is to shut off or turn on the compressed air feed into the CDV 30 and second is to close a door 36 to shut off PAPR air to an inlet cavity 38. In APR mode and with an SCBA tank handwheel opened, medium pressure air (typically about 120 psig) is sent down a first signal line 46 to the switch 40 at the proximal end of the hose 20. When a user rotates the knob 42 to open the switch 40 at SCBA mode, the 120 psi air is sent back to the CDV 30 via a second signal line 48 which pushes a spool piston 44 downwards, opening a passageway to allow the 120 psi air into the CDV 30 and shutting the PAPR door 36 so that the air from the SCBA flows through the breathing hose 10, 10' according to the wearer's demand. By closing the door 36, air from CDV 30 which is supplied at a slightly positive pressure is prevented from flowing back down the hose into the PAPR assembly as shown in FIG. 4*a*. Preferably the first and second signal lines 46, 48 comprise 1/16" ID conduits. The first and second signal lines 46, 48 may be disposed inside the breathing hose 20 so they are protected by the hose. When a user selects PAPR mode on the switch 40, return air in the second signal line 48 is stopped, releasing pressure on the spool piston 44 where a bias (such as from a spring 45) urges the spool piston upwards, releasing the door 36 toward an open position and enabling air flow from the PAPR to the breathing hose 10, 10' as shown in FIG. 4*b*. Simultaneously, an electrical contact is closed sending a signal on an electrical signal line 50 through the hose and to energize the PAPR blower. When a user selects APR mode on the switch 40, the electrical contact is opened to cease energizing the PAPR blower and allowing unforced air via the filters in the PAPR to the breathing hose 10, 10'.

Figure 5:
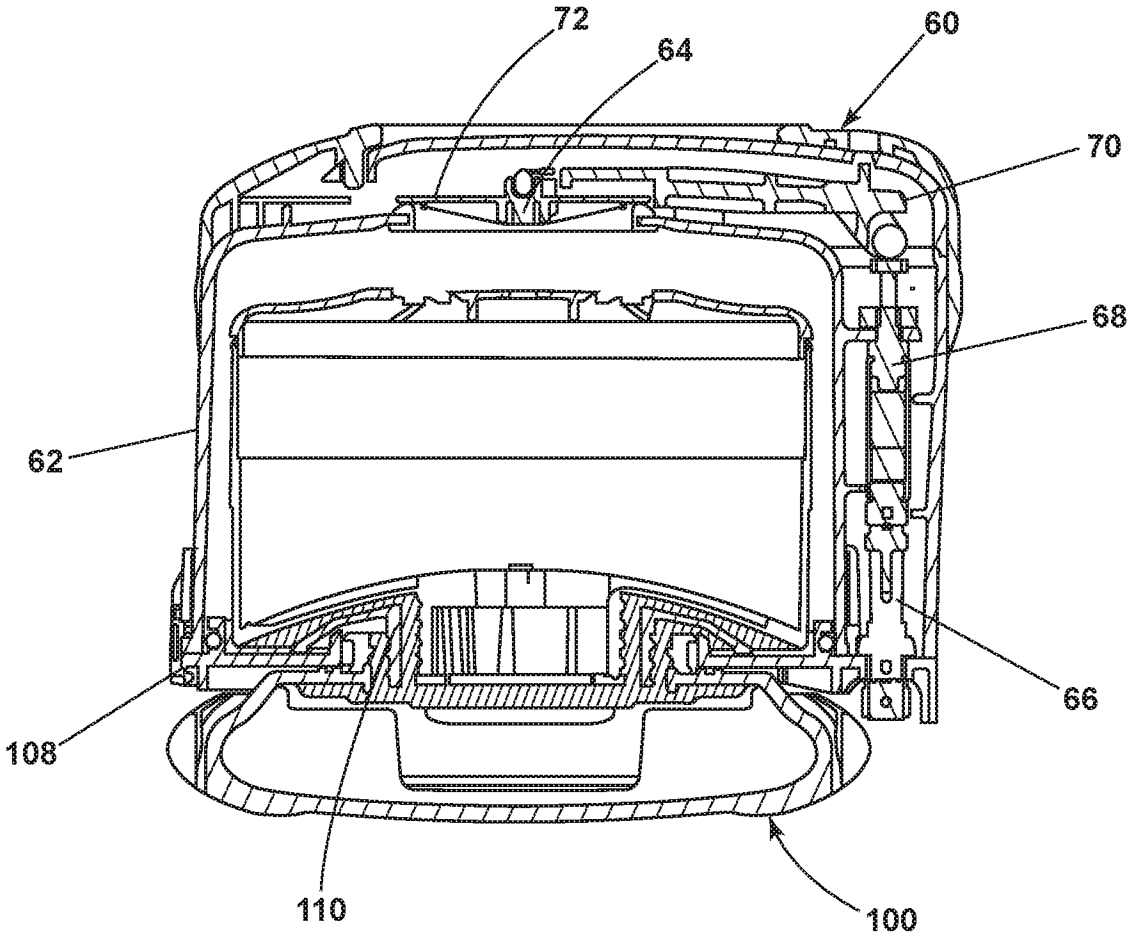
FIG. 5 is a cross-sectional view of a filer cover accessory for a powered air purifying respirator manifold according to the invention.
Figure 6:
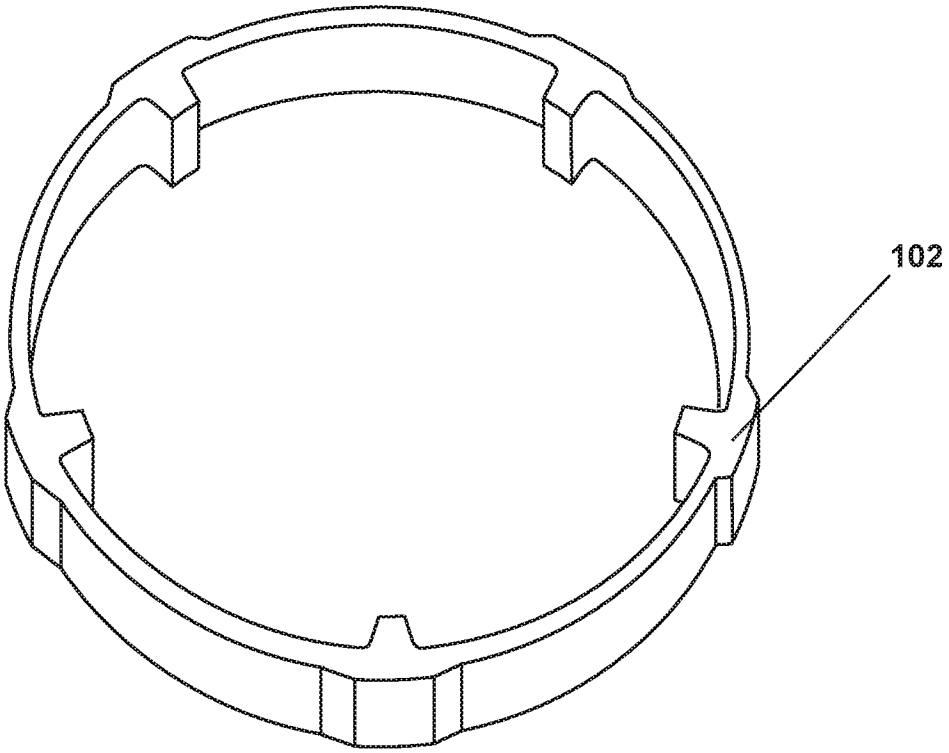
FIG. 6 is a perspective view of a tool to adapt a powered air purifying respirator manifold to receive the filer cover accessory of FIG. 5.
Figure 7A:
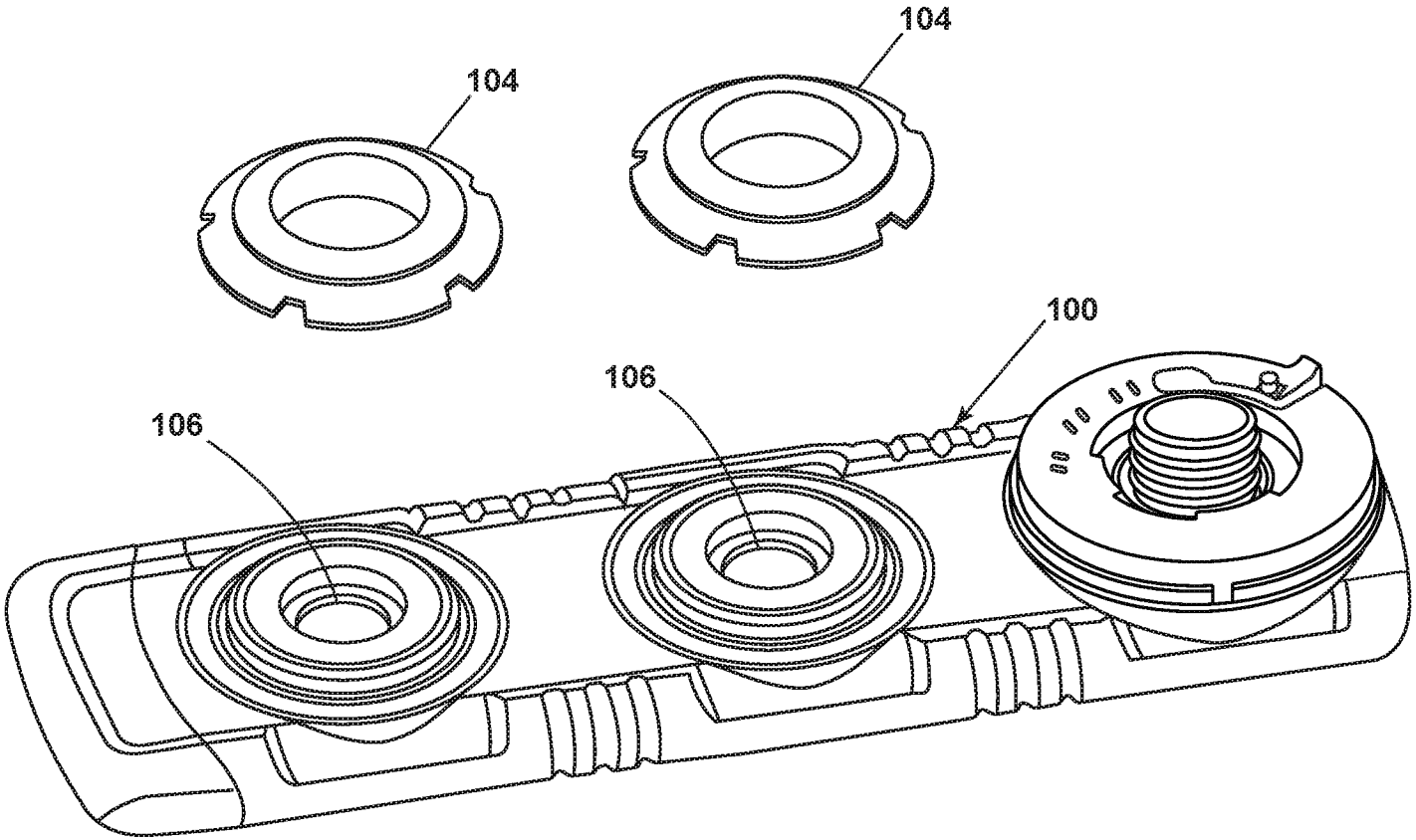
FIGS. 7*a*, 7*b* and 7*c* show steps of using the tool of FIG. 6 to adapt a powered air purifying respirator manifold to receive the filter cover accessory of FIG. 5.
Figure 7B:
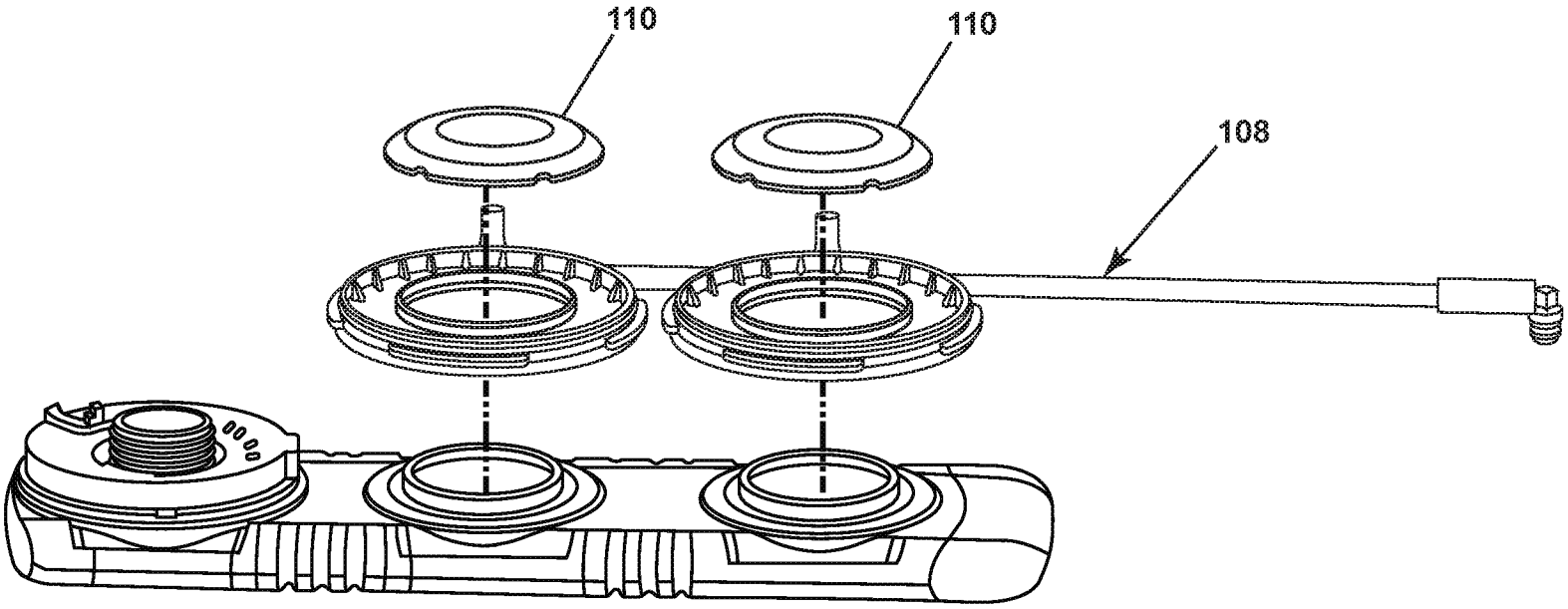
Figure 7C:
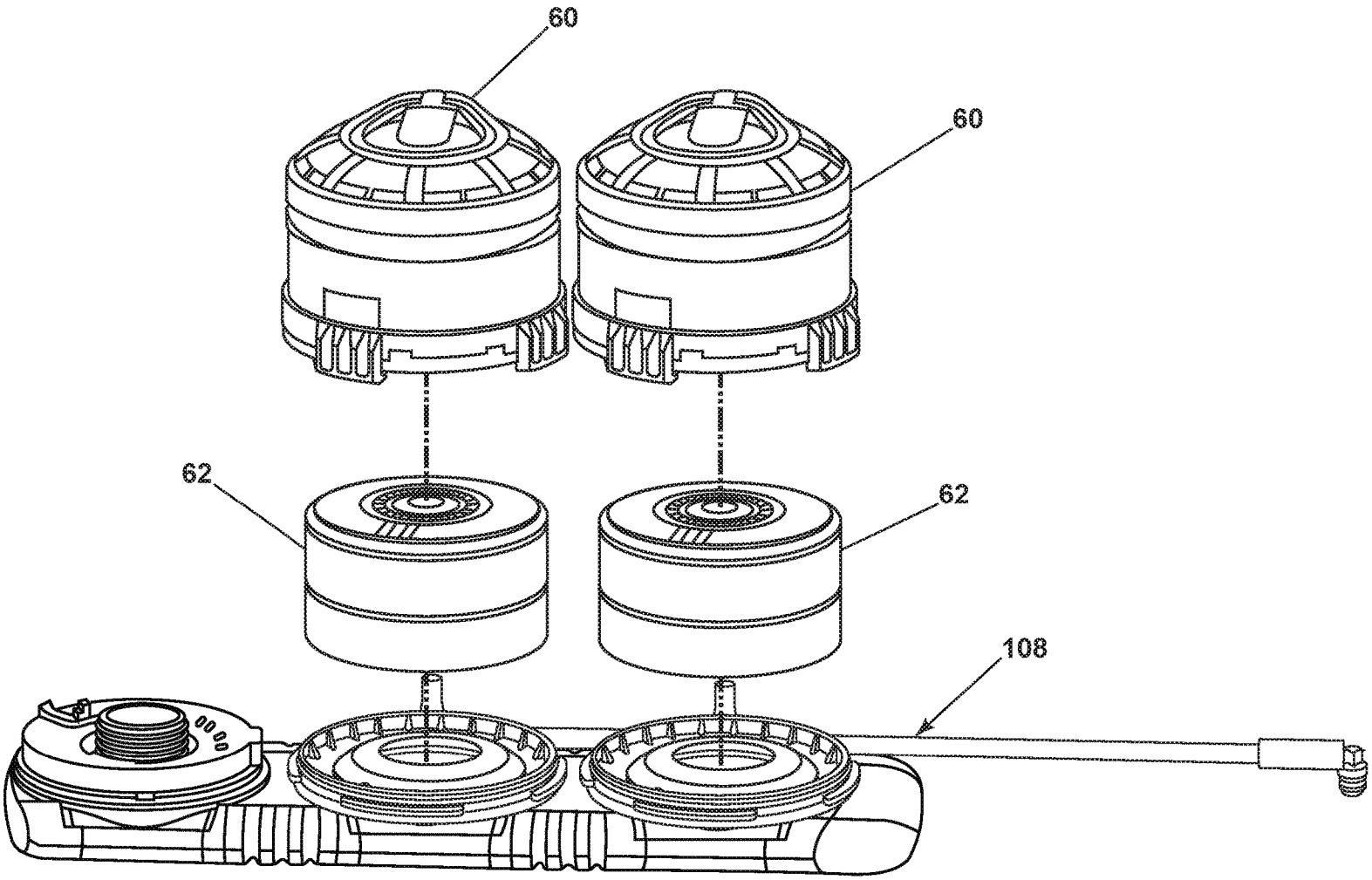

Turning now to FIGS. 5-7, a filter cover accessory 60 is a modular accessory to a PAPR manifold 100 as disclosed in U.S. Pat. No. 860,778, the entire disclosure of which is incorporated herein. The filter cover accessory 60 automatically seals off a PAPR filter 62 from the environment when a breathing apparatus is operated in SCBA mode. This sealing protects the filter 62 from premature degradation, especially in an environment immediately dangerous to life or health (IDLH). The filter cover accessory 60 is powered by the medium pressure air from the SCBA and is controlled by the switch 40. It defaults to open an inlet 64 to the PAPR filter 62 when either SCBA is switched off or SCBA air is depleted. When SCBA mode is selected, the switch directs medium pressure air from the SBCA enters a bottom fitting 66 (that preferably has an auto shut capability when pressurized air is not present) and activates a piston 68 to push against a lever arm 70, which closes a valve 72 at the inlet 64.

With the auto shut off capability, the filter cover accessory 60 can be removed in field while not depleting SCBA air. An external rubber boot 74 may be used to prevent direct water impingement upon the air inlet and further improve the water tightness of the assembly. Thus, a user can stand within a decontamination shower and the CUR system 20 will prevent water ingress even when the SBCA is connected and the filter cover accessory 60 is activated.

To adapt a filter cover accessory 60 to an existing PAPR manifold 100, a special tool 102, shown in FIG. 6, is used to unscrew plastic caps 104 normally disposed on the PAPR manifold 100 at each port 106. The same tool 102 is used to install an adapter plate assembly 108 to the manifold 100 with two aluminum lock rings 110. A threaded PAPR filter 112 can then be screwed back into each PAPR port 106, and a filter cover accessory 60 is disposed over each of the PAPR filters 112. The bottom lock ring 114 on each filter cover accessory 60 rotates to lock the cover securely onto the adapter plate assembly 108.

Turning again to FIG. 8, the manual switch 40 can be replaced with an automatic switching system to automate a switch function depending on detected gas levels. The system includes the above described CDV 30 connected via the first connector 24*a* to an SCBA and via the second connector 24*b* to a PAPR. A pneumatic switch 200 is connected to a controller 202, which in turn is connected to a set of sensors 204, 206, 208. The combination hose 10 extends between the CDV 30 and a mask 210 worn by a user. Sensor 204 can be an internal sensor within the hose 10 or an external sensor configured to measure oxygen levels. Sensor 206 can be an internal or external sensor configured to measure carbon dioxide levels. Sensor 208 can be an external sensor configured to sense other gas levels in the ambient environment. The pneumatic switch 200 is further connected to a solenoid 210 in the medium pressure line feed from the first connector 24*a* and the SCBA which controls the airline feed from the SCBA to trigger the mode switching as described above. It will be understood that there are two concepts considered herein (1) use of an external gas measuring instrument 220 to sense oxygen, CO or other gases, to determine which mode to be selected, for example SCBA mode in the event of oxygen depletion, the presence of CO, or a high concentrations of other gases, and (2) use of an internal gas measuring instrument 230 to sense downstream of the filter to ensure that the air being supplied is of adequate quality and if not, then automatically selecting SCBA mode. Signals from the instruments 220, 230 are sent to a controller 240 that is configured to process the signals, compare gas levels against predetermined thresholds, and take some action based on the comparisons.

Different applications may require different approaches to the actions of the controller 240. For example, when used in a known environment such as an industrial workplace, with a gas challenge that is predictable, the controller 240 can automatically operate the switch 200 to select SBCA air or PAPR air or APR air as the case may be. However when in a CBRN scenario where a challenge maybe unknown, a user may want the option to make manual changes to the operating mode. For example, to approach the potential threat in SCBA mode only irrespective of the measured condition at the time. Three potential operational scenarios are contemplated:

1) Fully automatic operation without user intervention
2) Semi-automatic operation with some user input
3) User override in some circumstances In the latter two scenarios, an alert mechanism 250 is provided to alert a user to a need to make a decision. Alert mechanisms 250 include an audible alarm, a basic LED Heads Up Display (HUD), a look down HUD that can provide additional data and a new generation of LCD miniature screens in a wearer's line of sight.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A combination unit respirator comprising:

a breathing hose having a first end and a second end, the first end configured to connect to a respiratory apparatus worn by a user;

a demand valve in fluid communication with the second end, the demand valve having a first connector configured to connect to a self-contained breathing apparatus (SCBA) and a second connector configured to connect to a powered air purifying respirator (PAPR); and a switch coupled to the demand valve by first and second signal lines that enable the demand valve to cause air flow from one of the SCBA or the PAPR to the breathing hose based on a position of the switch.

2. The combination unit respirator of claim 1 wherein the breathing hose comprises an outer chemical barrier layer and a reinforced inner hose.

3. The combination unit respirator of claim 2 wherein the reinforced inner hose comprises a wire helix enclosed in a thermoplastic polyurethane sleeve.

4. The combination unit respirator of claim 1 wherein the switch is at the first end of the breathing hose.

5. The combination unit respirator of claim 1 wherein the switch is a three position switch selectable among positions enabling one of air purifying respirator (APR), SCBA or PAPR modes.

6. The combination unit respirator of claim 1 wherein the switch is a pneumatic switch.

7. The combination unit respirator of claim 1 further comprising at least one sensor and a controller coupled to the sensor, the switch, and the demand valve, wherein the controller is configured to automatically select between SCBA or PAPR modes based on a signal from the at least one sensor.

8. The combination unit respirator of claim 1 further comprising at least one sensor and a controller coupled to the sensor, the switch, and the demand valve, wherein the controller is configured to actuate an alert mechanism to alert the user to activate the switch based on a signal from the at least one sensor.

9. The combination unit respirator of claim 8 wherein actuating the alert mechanism includes a notification of which mode to select.

10. The combination unit respirator of claim 8 wherein the alert mechanism includes one of an audible alarm, a basic LED Heads Up Display (HUD), a look down HUD that can provide additional data, or a miniature screen.

11. The combination unit respirator of claim 1 wherein the first and second signal lines are disposed in the breathing hose.

12. The combination unit respirator of claim 1 wherein the first signal line is a pneumatic line extending between the switch and the first connector, and the second signal line is a pneumatic line extending between the switch and a spool valve in the demand valve.

13. The combination unit respirator of claim 12 wherein the spool valve is connected to a door at an inlet cavity in fluid communication with the PAPR.

14. The combination unit respirator of claim 13 wherein the door is biased toward an open position enabling air flow from the PAPR through the inlet cavity to the breathing hose.

15. The combination unit respirator of claim 13 further comprising an electrical circuit between the switch and the PAPR wherein when the switch is selected to PAPR mode, an electrical signal sent from the switch over the electrical circuit actuates a blower in the PAPR.

16. The combination unit respirator of claim 14 wherein when the switch is selected to SCBA mode, air is enabled to flow through the second signal line to urge the spool valve to close the door blocking air flow from the PAPR through the inlet cavity to the breathing hose.

17. The combination unit respirator of claim 1 further comprising a filter cover accessory in the PAPR configured to seal off a PAPR filter from ambient air when SCBA mode is selected at the switch.

18. The combination unit respirator of claim 17 wherein the filter cover accessory is powered by an electrical circuit from the SCBA and defaults to open an inlet to the PAPR filter when SCBA mode ceases.

* * * * *